US006393735B1

(12) United States Patent
Berggren

(10) Patent No.: US 6,393,735 B1
(45) Date of Patent: May 28, 2002

(54) RUNNING WHEEL SHOE

(76) Inventor: Svante Berggren, Strandvägen 10, Furusjö, S-566 91 Habo (SE)

( * ) Notice: Subject to any disclaimer, the term of this patent is extended or adjusted under 35 U.S.C. 154(b) by 0 days.

(21) Appl. No.: 09/331,641

(22) PCT Filed: Dec. 23, 1997

(86) PCT No.: PCT/SE97/02206

§ 371 (c)(1),
(2), (4) Date: Jun. 22, 1999

(87) PCT Pub. No.: WO98/27839

PCT Pub. Date: Jul. 2, 1998

(30) Foreign Application Priority Data

Dec. 23, 1996 (SE) ..... 9604773
Oct. 27, 1997 (SE) ..... 9703919

(51) Int. Cl.[7] ..... A43B 5/00
(52) U.S. Cl. ..... 36/129; 36/132; 36/7.5; 36/25 R
(58) Field of Search ..... 36/1, 81, 103, 36/110, 113, 116, 129, 132, 7.5, 25 R

(56) References Cited

U.S. PATENT DOCUMENTS 887,752 A * 5/1908 Beck et al.
1,021,142 A * 3/1912 Freeman
2,317,020 A * 4/1943 Banister
2,758,394 A * 8/1956 Whitlock
3,156,988 A * 11/1964 Rause
3,996,677 A * 12/1976 Reina
4,041,619 A * 8/1977 Sapper
4,348,821 A * 9/1982 Daswick
4,856,599 A * 8/1989 Stammen
5,507,106 A * 4/1996 Fox
5,907,913 A * 6/1999 Kock
5,974,699 A * 11/1999 Park

FOREIGN PATENT DOCUMENTS

| | | | |
|---|---|---|---|
| DE | 3245182 | * | 5/1983 |
| DE | 3406039 | * | 9/1985 |
| EP | 600145 | * | 6/1994 |
| FR | 1128009 | * | 1/1957 |
| WO | 8103414 | * | 12/1981 |

* cited by examiner

*Primary Examiner*—Ted Kavanaugh
(74) *Attorney, Agent, or Firm*—Orum & Roth

(57) ABSTRACT

A running shoe having a heel, a toe and exhibiting a frame and an underlying sole for running. The front toe part is arranged to extend from a linear orientation with respect the frame to an upward bent orientation at an angle from the rear heel part of the frame. The sole having a front circular member and a back circular sole member wherein the front circular member having a break edge that is arranged to exhibit a fall function for the shoe after its contact with and roll off along a surface.

2 Claims, 6 Drawing Sheets

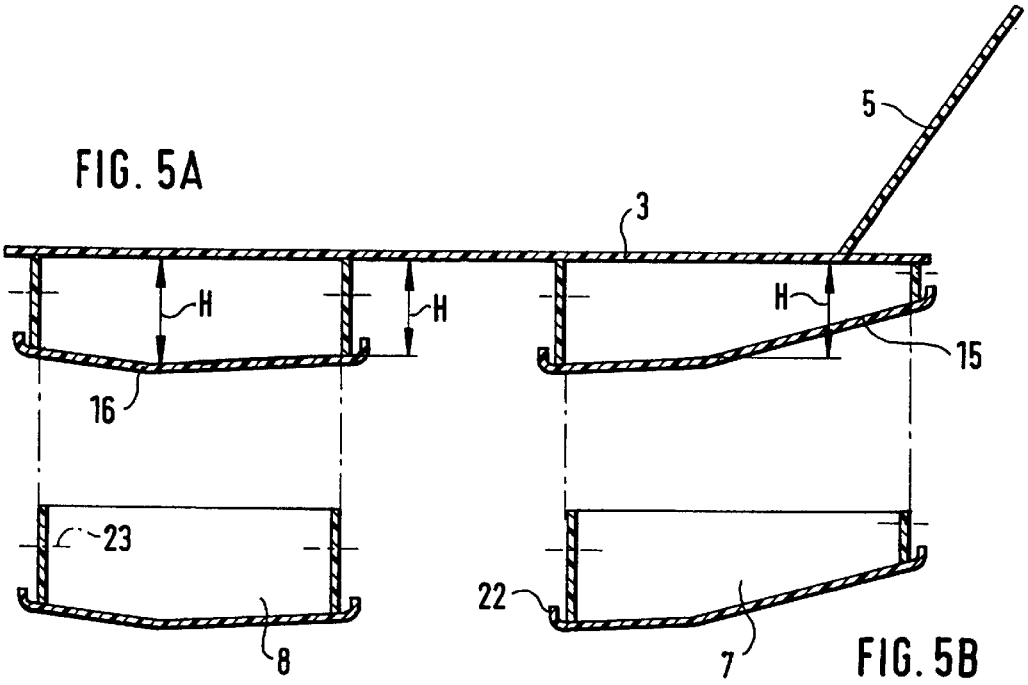
FIG. 5A
FIG. 5B
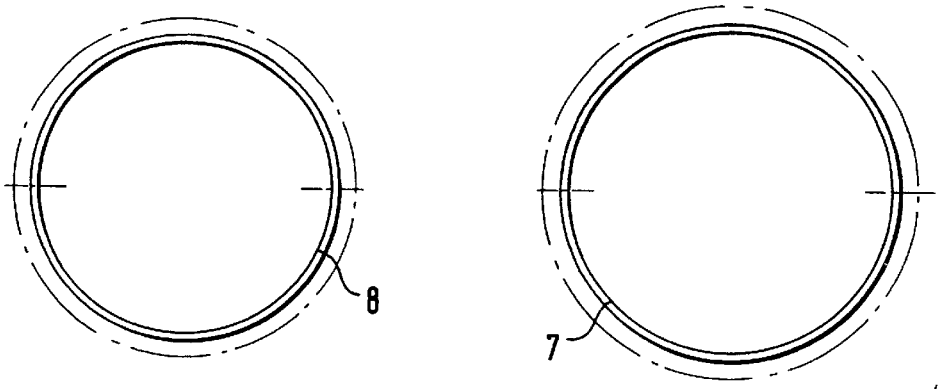
FIG. 5C
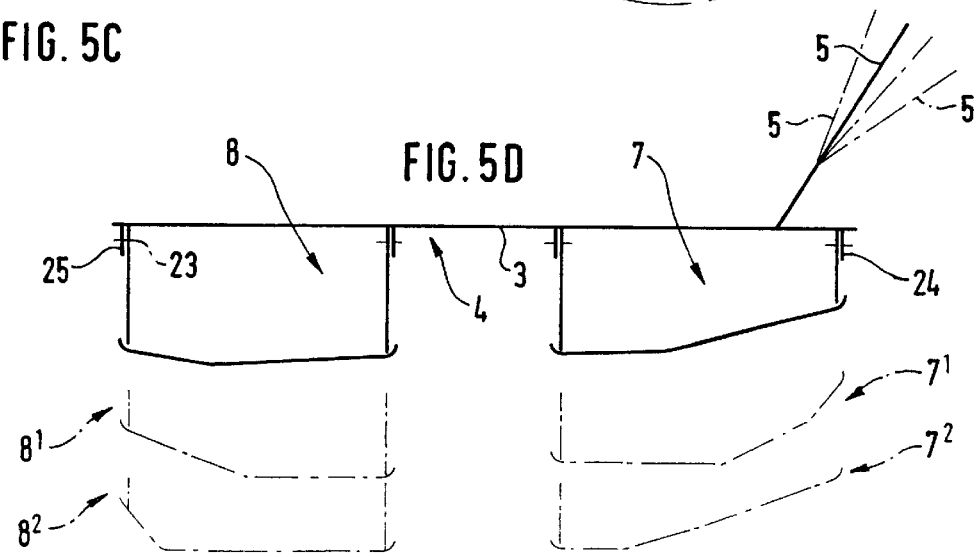
FIG. 5D

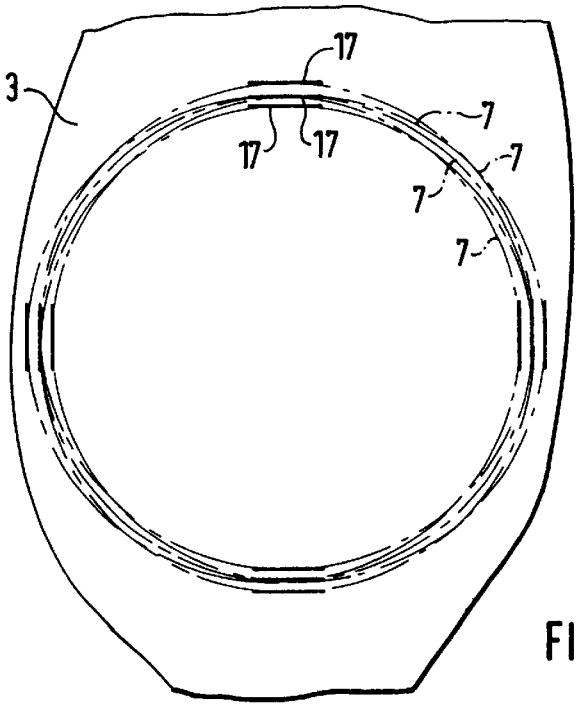
FIG. 6A
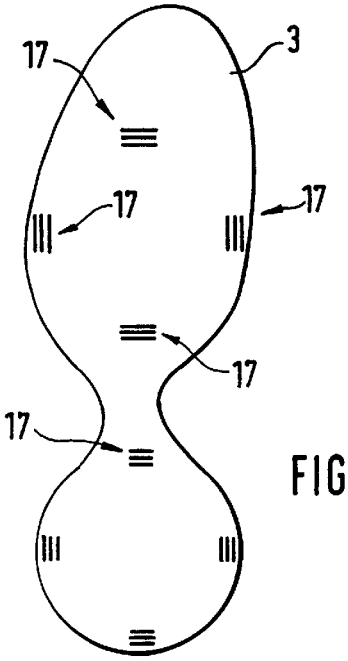
FIG. 6B
FIG. 6
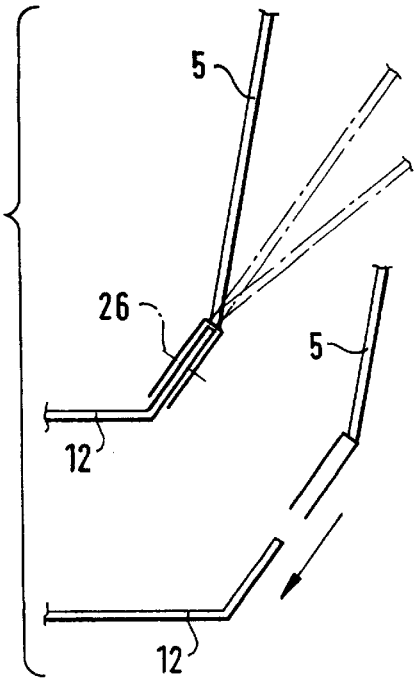

FIG. 7
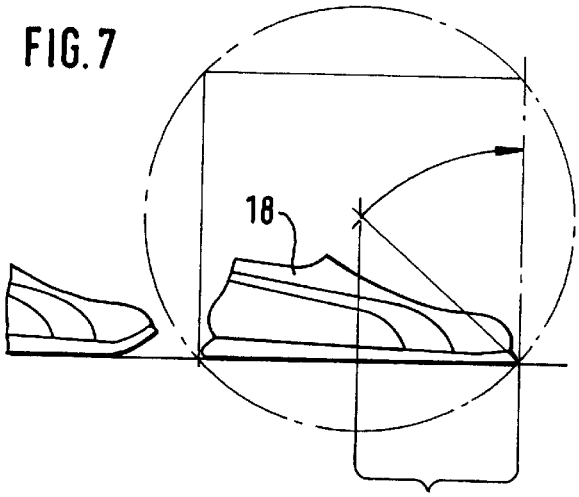
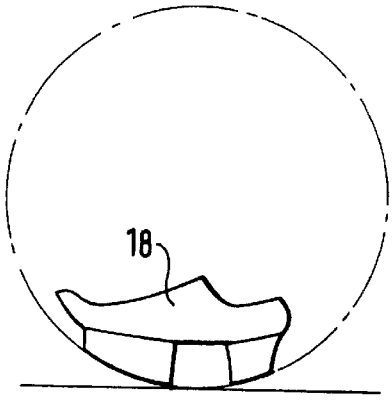
FIG. 10
FIG. 8
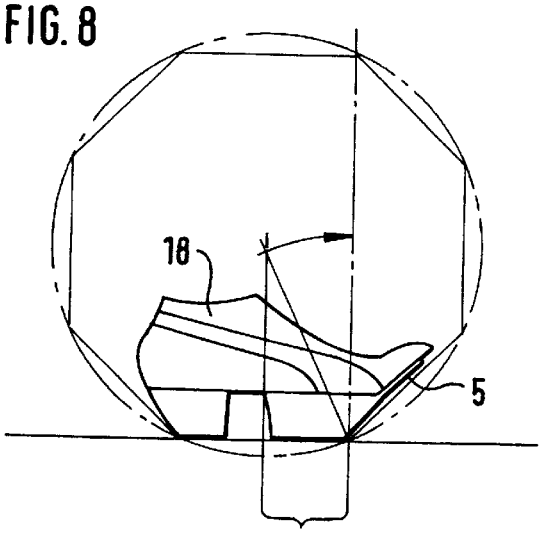
FIG. 11
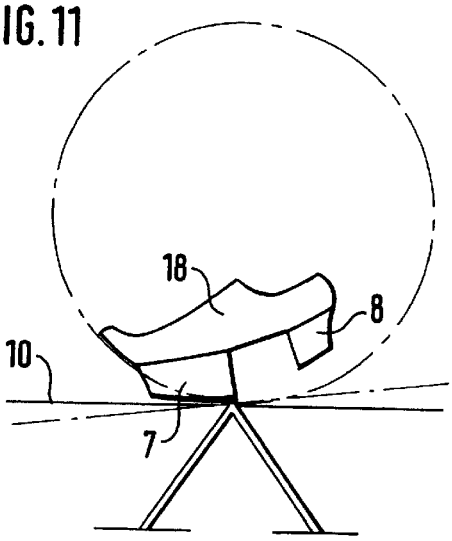
FIG. 9
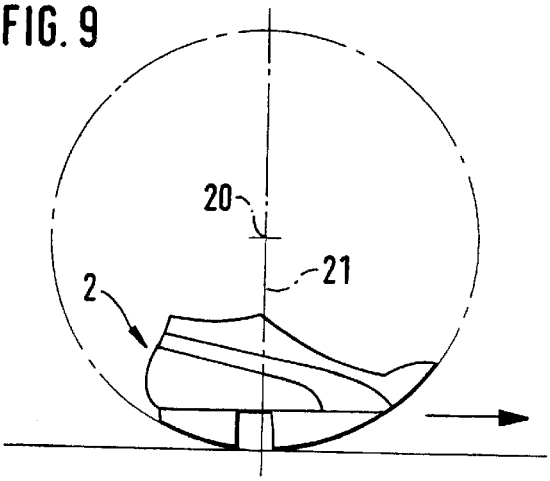
FIG. 12
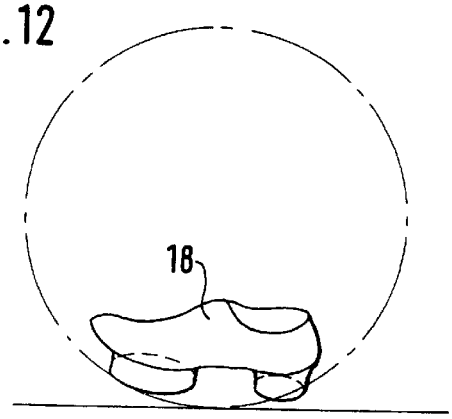

RUNNING WHEEL SHOE

This is a 371 of PCT/SE97/02206 filed on Dec. 23, 1997.

The present invention relates to a shoe which preferably is intended for running and which exhibits a frame and an underlying sole.

The shoes which are used today for competition or exercise running usually includes a substantially flat and flexible sole, at which the shoe also exhibits a large weight. According to an investigation, the average weight was about 350 grams per shoe.

This results in that the risk for damages will be large, due to for example incorrect positioning of the shoes when contacting the ground-level plan and that you can not to a maximum exploit the dynamic forces that are generated during the time in which the shoes are used for running.

The main object of the present invention is therefore primarily to solve said problems with efficiently and securely functioning shoes by its construction so that its material, shape and function co-operates for an optimum use of bio-mechanical laws, angles, shapes and forces.

The aforementioned object is achieved by means of a shoe in accordance with the present invention which is primarily characterized in that the frame comprises a front toe member which is principally rigid in a downward direction and that the sole is formed by a number of arched members the front part of which exhibiting a break edge which is arranged to provide fall function for the shoe after its contact with and roll off along a surface.

Figure 1:
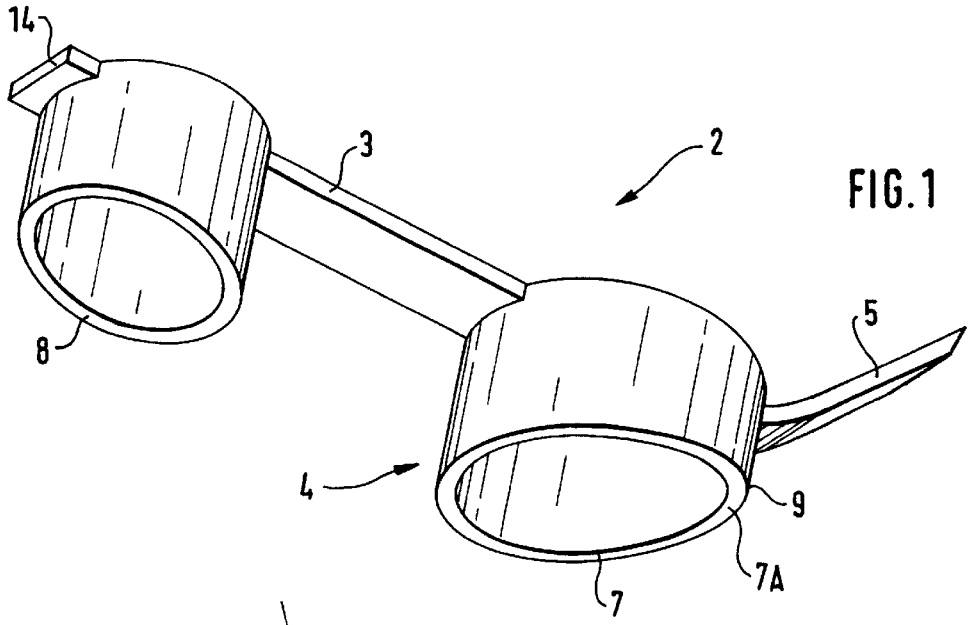
Figure 2:
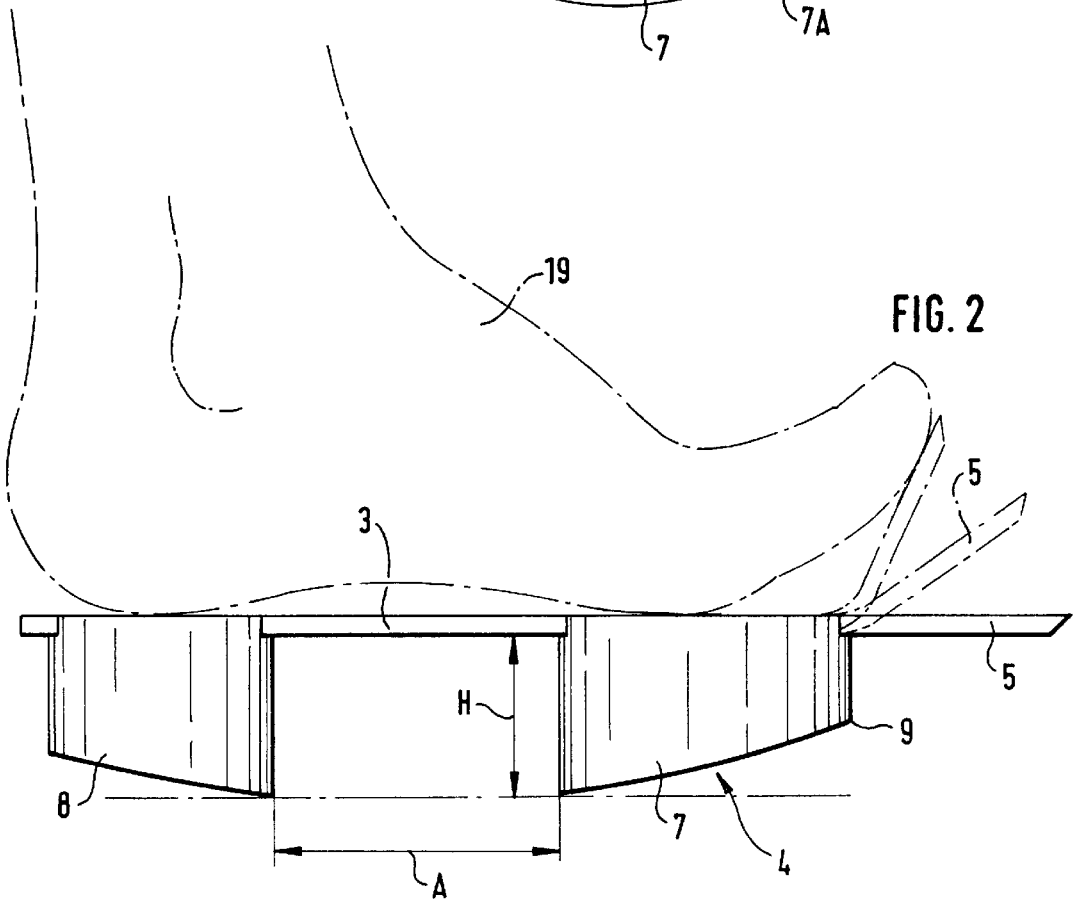
Figure 3:
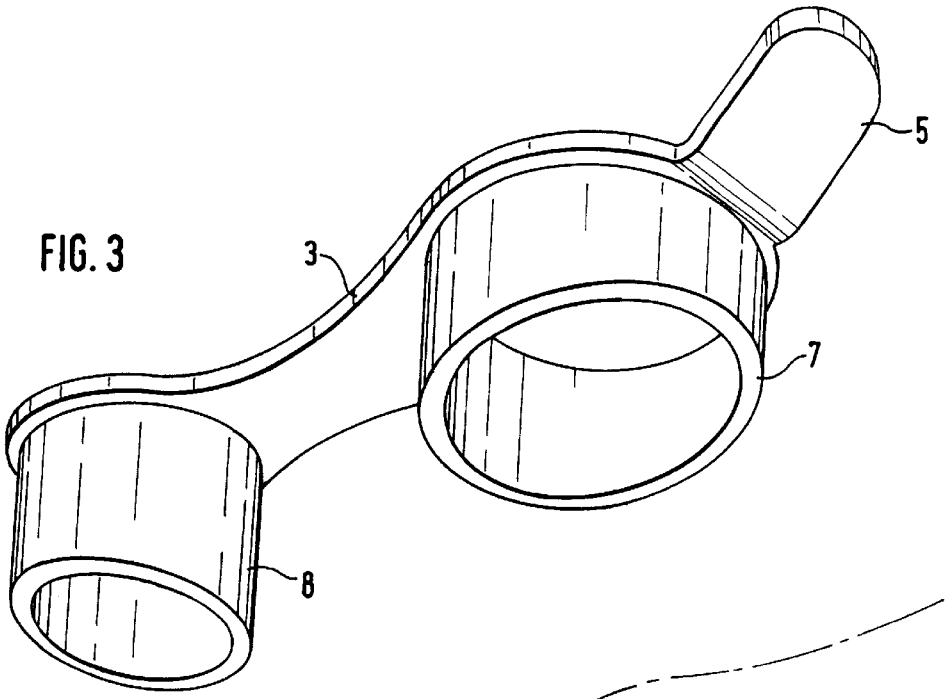
Figure 4:
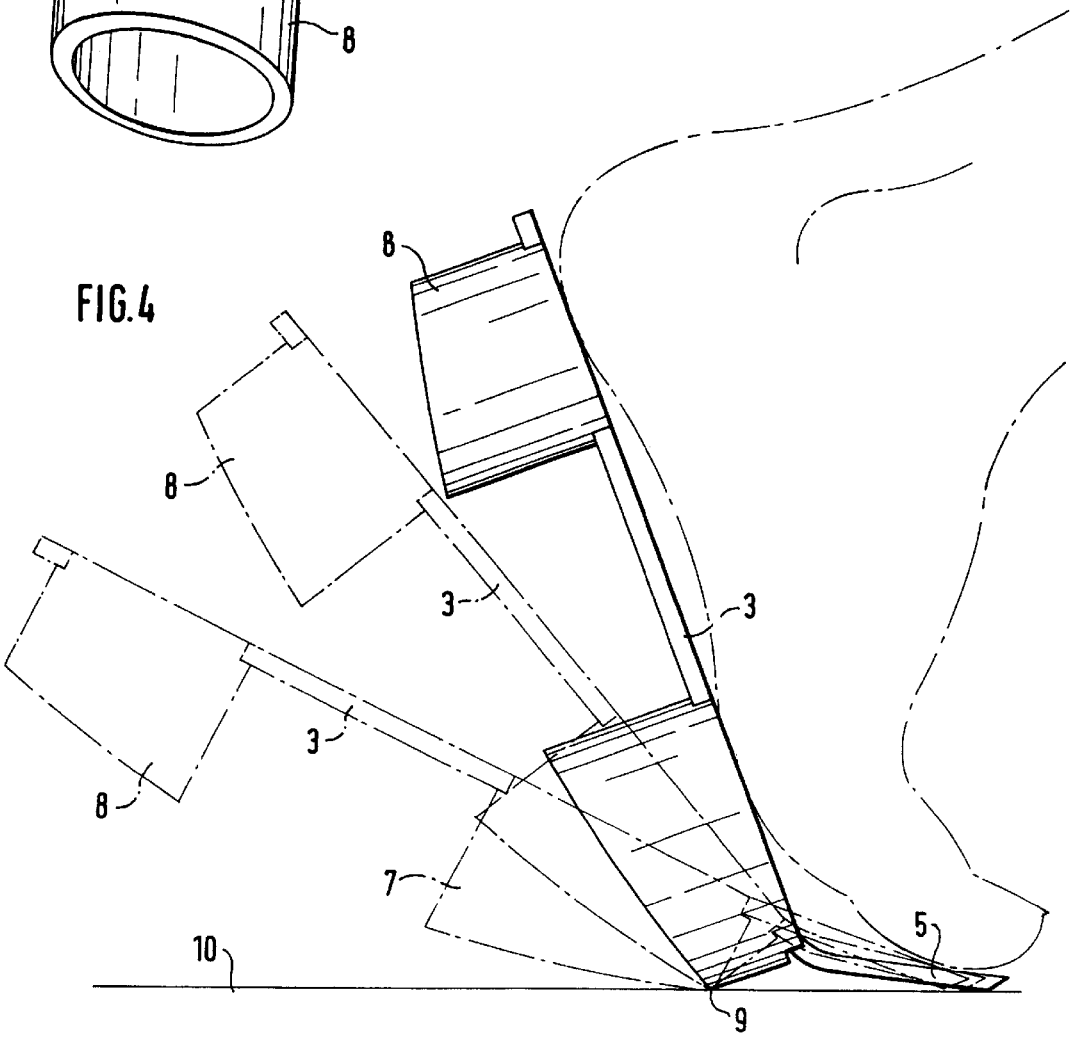
Figure 5:
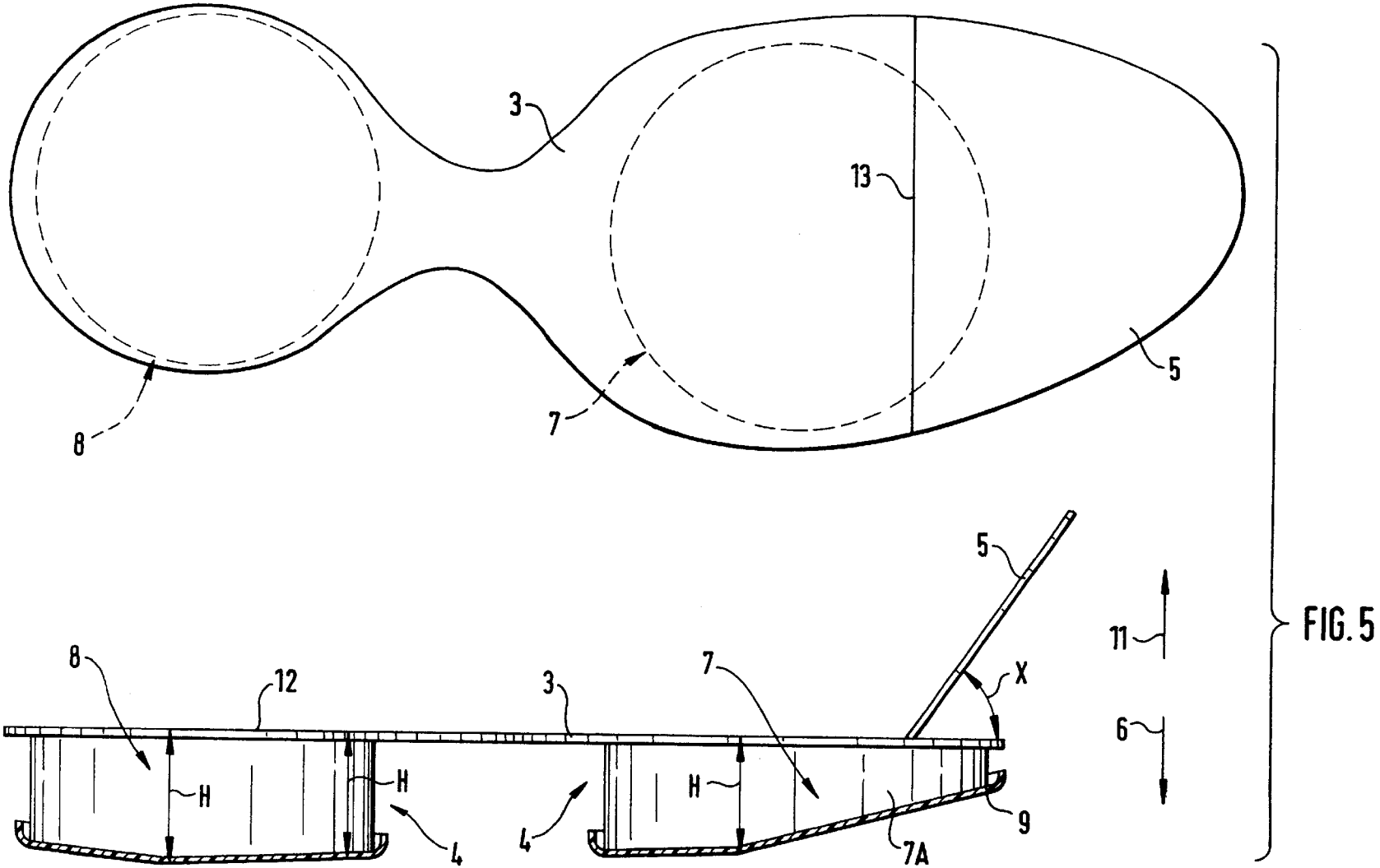

The specific geometry of the invention regarding the contact of the shoe with the surface and the general construction of the shoe among others shall in the following be described with reference to the accompanying drawings, in which FIG. 1 shows in perspective, the main part of a shoe according to the invention seen diagonally from below and from behind, FIG. 2 shows schematic side view of the shoe in an operational position of rest, FIG. 3 shows in perspective the shoe seen diagonally from below and from the front, FIG. 4 shows the shoe in operational upwards pivoted position of tipping, FIG. 5 shows an example of the shoe schematically shown from below, FIG. 5A shows a side view of the bottom part of the 15 shoe, FIG. 5B shows examples of loose attachable wear sole elements, FIG. 5C shows the wear sole elements seen from below, FIG. 5D shows a side view of the bottom part of the shoe with exchangeable circular wear sole elements, FIG. 6 shows schematically a removable attached toe part, FIGS. 6A and 6B shows different attachable circular sole members and their variable attachments, FIG. 7 shows schematically the function of a conventional shoe during running, FIG. 8 shows the object of the invention in shown function of running, FIG. 9 shows the weight distribution of the shoe, and FIGS. 10–12 shows the principle with the present shoe according to the running wheel, the balance and the circle.

According to the invention, which relates to a shoe, which preferably is intended for running and exhibits a frame 3 and an underlying sole 4, the frame 3 includes a front toe part 5 which is principally rigid and in certain cases completely rigid in direction downwards 6 but preferably also in the direction upwards.

The toe part 5 is arranged to extend from straight shape to upward bent shape 11 in angle X between about 0° and 500° from the remaining part 12 of the frame 3 along a straight transverse line 13, and which toe part may be arranged detachable attached to said rigid frame 12, which for example is shown in FIG. 6 by means of for example screw 26 or other means of attachment.

The transverse frame line 13 crosses the front circular sole member 7 between its middle and front edge 9. It is also possible to make a completely straight toe part 5, level with frame 3.

The sole 4 is preferably formed by two at mutual distances A from each other located lying circular sole members 7, 8, which may decrease in height H in the direction towards the toe 5 and heel part 14 of the respective shoe. Furthermore, the circular sole members 7, 8 may exhibit an arched shape or a distinct difference of level along its longitudinal dimension and exhibits substantially equal thickness and are comparatively elastic downwards. The shoe frame 3 is rigid and preferably consists of composite material, so called prepreg which is included among epoxyl resin impregnated carbon, glass, or aramide fibers.

Sole pads 15, 16 with suitable shape are preferably arranged to close the circular sole members 7, 8 in the direction downwards preferably consisting of carbon fiber material or other rigid or elastic material.

Thereby is at least the front of the two circular sole members 7, 8 journalled rotary movable, preferably by means of binding bearings 17 which are circular distributed and radial displaced for adapting to receive between them circular sole members 7, 8 of varying diameter and/or to be attached on different radial displaced locations. The frame 3, which may be formed with a not shown loose insert into the casing of the shoe 18, or be adapted to be attached to a foot 19 by means of not shown catching belts, a casing or a shoe shaped receiving member 18.

The aforementioned circular sole members 7, 8 may vary in stiffness from substantially to completely stiff and the frame 3 and/or the sole 4 is completely stiff. It is also possible to attach the invention to existing shoes.

As is illustrated in FIG. 8, the breaking effect of the shoe will be substantially smaller than with a conventional shoe and that the center 20 of gravity is close to the vertical line 21.

Further, the sole pads 15, 16 may be adapted to be clamped to the circular sole members 7, 8 by means of an all round going flange 22 alternatively attached by means of, for example, screws 23.

The profiles of the circular sole members 7, 8 may vary from straight shape to circular shape with intermediate suitable shapes, like arched shape at which the formed straight or arched break edge 9 extends across the longitudinal length of the shoe, this is turned towards the toe part or the heel part of the shoe.

The toe part 5 may also have a straight shape or may be arched as the drawings show.

The entire or at least the toe part 5 of the frame 3 is at least substantially rigid in the direction downward 6 but may vary up to completely rigid arid thus inflexible. For this object, the entire or at least the toe part 5 of the frame 3 may also be from substantially to completely rigid in the direction upwards 11, in order to allow the frame 3 and its toe part 5 to cooperate with the support when the toe part gets into contact with the surface 10.

Furthermore, such a frame 3, which have been made in accordance with the above described with appurtenant toe part 5 may be arranged receivable in a conventional shoe wherein circular sole members 7, 8 according to the above described may be attachable under such a conventional shoe.

A combination of the specified characteristics are also possible to apply at more or less conventional or according to the invention realized shoes with reference to the frame 3 and the sole 4.

In FIG. 5D is shown how a molded sole 4 which exhibits in pairs downwards turned receptacle circles 24, 25 in which parts of circular sole members $7^1$, $7^2$, and $8^1$, $8^2$, respectively may be attached by means of for example a screw 23.

Technical Properties for the Shoe in Accordance with the Present Invention

Weight

60–80 gram/shoe probably makes the object of the invention the world's lightest running shoe. To compare with e.g. Michael Johnson's gold shoes from Atlanta Olympics which weighted 94 gram/shoe.

341 gram is the average weight for 19 different running shoes year model 1996. Rad & Rons shoe test, nr 6–7 1996, presents the leading market companies best products. With these shoe weights, the Marathon runner lifts about 8600 kg. With the object of the invention, tire corresponding sum will be only about 1700 kg. The difference is enormous. The significance of the weight has definitely been underrated by the shoe industry. The low weight naturally leads to energy savings and thereby results/time-savings. The low weight is also a very important factor for preventing injuries. Materials and construction in accordance with the circle principle is the prerequisite for the extremely light object of the invention.

Stability

A stable, from completely inflexible to substantially inflexible sole construction. The running wheel principle requires, in order to work, a shoe which is inflexible in accordance with the above. The profile of the sole, balanced in accordance with the balance principle, and designed in accordance with the circle principle, results in a total of a very efficient shoe. The step cycle of the object of the invention, the suspended phase, the foot contact support phase, push away phase/extension phase will be very fast, energy saving and preventing injuries.

Speed 0.70–0.80 second faster/100 m is the object of the invention comparison with a normal running shoe. The minimal weight and the design according to the three basic principles leads to an optimum use of the bio-mechanical laws. This provides the increased speed. The fact is that traditional sole materials shock absorb away energy and speed.

The Three Basic Principles of the Object of the Invention

A. The principle of the running wheel comprising a circular inflexible sole profile with break edge. The ground contact will he very fast because the center of gravity of the body coincides with the vertical line above the point of support. See FIGS. 8–10.

B. The principle of the balance. The object of the invention may be balanced by adjusting the circle of the forefoot and the circle of the heel in distance, angles, height and diameter. It is then possible to run on so called "falling center of gravity", which the sprint runner does in the moment of starting and accelerating. In the upright running the foot subsequently passes the vertical line and a braking moment is created. With the object of the invention, it is possible to maintain the "falling center of gravity" or in center of gravity/vertical line where no breaking moment exists. See FIG. 11.

C. The principle of the circle. The contact surfaces of the sole against the ground consists of "lying circles'. Here is the relationship of the circle to forces applicable. Independent of the point where the circle meets forces, during foot insertion—support—or the phase of pushing away/extension, the force of movement creates a counter force which then goes through the center point of the circle. The feeling of stability, balance and concentrated force to the middle point of the shoe is substantial. That the circles in forefoot and heel functions independently from each other and that the shape are precisely circles, probably reduces the spreading of the shock in the foot, lower part of the leg knee and hip. See FIG. 12.

Ground Contact

"Barefooted, without stockings and shoes . . . " The words of the song describes exactly the feeling created when running with the object of the invention. The feeling of barefoot! Perhaps the inherent supreme capacity of the foot for solutions is better preserved in the object of the invention than in the normal running shoe? An ability for solutions that the foot has developed over millions of years!

a) Insertion of the foot. Irrespective of the fact that where and how the insertion of the foot occurs, the circles normalize and stabilize the insertion of the foot. Injuries upon the Achilles tendon may be reduced radically. Problems with pronation and supination will not at all arise. See the principle of the circle, FIG. 12.

b) Support phase. The short support phase is the result of the three basic principles. Shock absorption is the short support phase. In traditional shock absorbing the step sinks down in the support phase during too long time, as in bog/marsh running. The object of the invention uses the intrinsic power of the running step, the step does not have time to sink but gets a direct response, which in asphalt running involves a quick support phase and provides energy saving, fast and injury preventing running.

c) Push off/extension phase. The inflexible sole material meets the forces of the running step. The equal height of the sole in both forefoot and heel provides an optimal leverage. In the built up heel of normal running shoes, the foot in contact with the ground lands in permanent "downhill slope", or with too much heel insertion and thereby large risk of injury. The sole profile with its break edge render the running step a more horizontal direction. The Olympic champion Vebjörn Rodal has made positive statements concerning a more horizontal step. During the World Championship in Göteborg, bio-mechanical investigations were made among the best triple jumpers (Friidrott nr 10 1995, Erik Simonsen, Denmark and others). The study shows the importance of horizontal direction of movement. Jonathan Edwards has lower projection angles in the three steps than fellow competitors. In the contact with the ground, the jump foot strikes on or near the vertical line. This results in maintained speed through the jump and besides a world record as expected. The construction of the object of the invention naturally leads to the following chain reaction; High heel, the feeling of "running high", low angle of push off—more level, longer step—maintained or increased step frequency. A simple explanation of why the time-savings are as large as 0.70–0.80 second/100 m.

Injury Preventing

The descriptions in the above points are altogether injury preventive descriptions. Daily practical training with the object of the invention shows no records of injuries. An important addition is that the circular shape of the shoe in the contact surface against the support may reduce rotational injuries in for example soccer. The foot is easier to rotate without getting stuck in the surface. Also, the object of the invention more easily follows rapid directional changes like for s example indoor bandy. Here the low weight is also a large benefit. The less weight a part of the body has in its outer positions, the less risk for injuries related to overloading. An old truth which the shoe industry has completely forgotten. This fact shows the altogether too heavy work shoes, leisure time shoes and running shoes. We must remember that the foot during large parts of the running step is positioned in outer positions, far away from the center of the body.

Material

The sole construction with the two circles are preferably built up from thin carbon fiber. Weight 35–50 gram. Carbon fiber is surely no end product but there are certainly lighter materials with the same strength. The casing 18 of the shoe can be made very simple. Weight 10–15 gram. It may consist of a reinforced sock, VELCRO hook and loop closing or other simple buckles. The above complemented with rubber or spikes, matched to the specific competition surface, on the contact surfaces, results in a total weight of 60–80 gram/shoe.

The basic material composite material, is so called prepreg, i.e. an impregnated fiber of carbon fiber, glass or aramide fiber which is impregnated with a certain amount of epoxyl resin, in order to obtain an optimum result both with regard to weight and strength. Curing takes place in an autoclave, i.e. a pressurized oven with control of vacuum, pressure and temperature. The result provides an unbeatable laminate in strength as well as in weight (extremely light). Rubber material, so called Trekollan disc 90 2–3 mm provides the wear surface which forms the contact to the support. Velcro closings or simple casing adapted to the of the foot is the means of attachment which is suitably used for an extremely light construction.

Tests

My earlier tests with running gave indirectly early the idea of a completely changed running shoe. During the latest two years, my daily running training was completely focused on developing the object of the invention. Objectively by time, pulse, step measuring, video and photo documentation. All in comparison between a large number of models and brands of normal running shoes. Subjectively through "running feeling", this important concept which has listened to the reactions of the foot and thereby has guided adjustments of angles, distances, sole heights and diameters in a total of 35 variants. The object of the invention is probably no end product but is only in the beginning of a series of positive events of development.

Future

Future with the object of the invention is the world star, sprint—middle-distance—long-distance runner who improves world records with the object of the invention.

The future is also to perform scientific tests and analyses in laboratory environment. That my hypotheses are assessed, that the bio-mechanical facts are elucidated, that world record runner feet perform the practical tests with the object of the invention.

See Opportunities

"Some feet wants willingly to win . . . "

The object of the invention for elite: sprint, medium, long-distance running, orienteering, team and racket sports. " . . . others only want to enjoy the experience".

The object of the invention for exercise: Jogging, walking and leisure time.

| Weight | |
|---|---|
| Conventional shoes | object of the invention |
| Leisure time/Jogging 350 g | -"- 70 g |
| Competition/spike shoes 200–94 g | -"- 70 g |
| Walking 1.5–2 kg | -"- 400 g |

A 5 times reduced weight involves large energy profits, increased speed and is injury preventing.

The circles stabilize the insertion of the foot and the push off, directs forces through the center point, normalizes pronation and supination.

Short support phase is shock absorbing which replaces traditional shock absorbing material by the rapid roll off to push off phase and the hard inflexible carbon fiber which is not exhausting or miss-setting. The center of gravity goes through or in front of the vertical line means that no brake action takes place.

The push off takes place quickly and energy saving. Running may be performed with "high heel" which then results in a more horizontal running, with longer push off angles. Furthermore, the shoe roll off provides 3 cm gain in distance for each step. Totally a gain in time of at least 0.70 second/100 m.

A technical revolution also for running, like the advancements which have been made in jumping, throwing and other athletic sports. The running wheel, balance, and circle principle provides these possibilities. All angles in insertion of foot and push off provides optimum effect.

Injury preventing technique and material. By minimum weight of the more or less circular path of the foot during a running step reduces the loading in the extreme positions. Pronation (uneven weight distribution of the inside of the foot), or supination (uneven weight distribution of the outside of the foot) is almost completely avoided by the hard material of the shoe, quick roll off and equal sole height in heel and forefoot. The object of the invention provides a natural, easy step with "barefoot feeling".

Advantages

I. Light, 60–90 gram

II. Stable, inflexible

III. Fast, the worlds fastest=Rolling wheel principle causes foot insertion to occur on or behind the vertical line and that you run on a "falling" center of gravity. This relationship causes the foot to move itself 3 cm forward during insertion of foot-support phase to full push off effect. The gain in time will as said before be 0.60–0.70 seconds per 100 m in comparison with a normal running shoe.

IV. The forces are equally distributed towards the center and the circle shape makes this possible. Irrespective of the fact that the direction is forward, the force arrows goes back through the center point of the circle. This reduces the risk for rotational injuries while the foot/shoe may very easily change direction.

V. A horizontal, more flat running step.

VI. Measurable alterations in balance-center of gravity vertical line by changes in the angles of the sole profile, the diameters of the circles, the height and distance between the circle on the forefoot and the circle on the heel.

VII Optimum leverage in the push off. Equal sole height forefoot-heel, or with somewhat lower heel.

VIII. Correctly balance and the sock idea is altogether possible which may result in the lightest shoe in the world IX. Injury preventing. Forget problems with pronation and supination. The rigid inflexible sole with efficient roll off according to "tipping" "balance", or "falling" center of gravity eliminates calf, Achilles tendon, foot injuries.

X. No expensive upper side. Lightest possible material= sock with reinforced heel.

Disadvantages/Difficulties

Leveling the angles, the relationship between forefoot and heel circles, height, diameter is more delicate than what may be recorded from common running tests. Therefore, it is required devices which more exactly can register advantages with different angles.

Leveling according to the above results in that it may become easy to "get stuck" in the support phase.

Form and Function

The material composite according to the above is a part of the sole construction of the shoe where the foot rests against, as well as the support elements which are attached under the sole and are placed in a front part and a heel part. The sole part is in the front part angled up, called "bent toe", ex 45–50 degrees. The support elements are circular, ex diameter of 6–10 cm, with a height of 0.5–3 cm.

The lower part of the circles constitutes the wear surface, i.e. the surface which is in contact with the surface. The means of attachment, the upper part of the shoe is composed of a Velcro closing or a casing.

The side profile, the different heights of the circle and "upwards bent toe" provides the object of the invention with the unique possibility of using bio-mechanical laws as basic principle.

A. The running wheel principle and basic principle B shows that the support elements, the horizontal lying circles which precisely is circular is partly that the strength increases but above all that bio-mechanical principles are used optimally. Acting for reducing the break effect (retardation) with 50% in comparison with the normal shoe, that the support phase time span is reduced with 25% and that the acceleration force increases with 60%. Here the forces and the angles cooperate with the inflexible construction. Here is again referred to the basic principles and its importance for the entire step cycle, insertion of the foot, support phase and push off phase.

SUMMARY

A. The extremely low weight, 70–90 gram per shoe, energy saving, i.e. about 6 tons less to lift during a marathon race in comparison with a traditional running shoe.

C. The foot insertion which always involve a brake action is here reduced with 50%. Besides, the circle construction and the hard material makes it impossible that the foot is pronated=uneven weight distribution inwards and supinated=uneven weight distribution for the foot outwards.

C. The support phase, which comprises the 300–400 milliseconds which a foot carries the weight of the body and movement. Bio-mechanical laws act here with a 50% shorter support phase time than with a traditional shoe.

D. The push off phase involves the support phase as well as the last part further on to where the foot leaves the surface. Here the acceleration force increases with 60%.

E. Injury preventing. In many contexts, the weight is an important factor with reference to injury preventing activities. This also is true for a shoe which works far away from the center of the body. The extremely low weight as well as the shape of the shoe, the material and the function which is based upon bio-mechanical principles, all this is injury preventing.

The specific geometry of the invention with reference to contact surfaces towards the ground-level plan as well as the general construction shall be explained more in detail in the following.

The invention consists of a support element and a primary and a secondary heel respectively. The support element is by means of a geometry which is adapted to its purpose intended to provide adequate basis/support concerning the arch of the foot. Support elements may be fixed at the foot by means of predestined fixing means, e.g. so called VELCRO hook and loop closings or in particular—after existing foot—anatomically adapted casing. At the support element may also be fixed an—adapted after the arch of the foot—comparatively elastic sole.

Primary heel and secondary heel is characterized in radial truncated conical elements, which contain geometrically predestined cavities. The radial truncated elements, primary circular sole member 7 and secondary circular sole member 8, are joined together with the support element. The purpose of the radial truncation of the circular sole members 7, 8, shall be explained in more detail in the following.

The primary circular sole member 7, and the secondary circular sole members 8, are oriented/designed according to a predestined relationship which is based upon the—in relation to the ground-level plan—vertical strike angle of the foot/shoe as well as kinetic components concerning bio-physical kinetic energy.

During insertion under movement, against the ground-level plan of the primary circular_sole member 7 and in a later stage the secondary circular sole member 8, is generated by means of specific radial truncation a propelling circular movement, which moves the is foot/shoe in the intended direction. Circular sole members 7, 8, may be coated at the contact surface towards the ground-level plan, with shock absorbing/comparatively elastic material.

In this manner is obtained—In comparison with existing shoes—a self-acting movement generated by means of the existing kinetic energy, kinetic energy of impact as well as the radial shaping of the circular sole members 7, 8, towards the ground-level plane.

The invention is not limited to the above described and in the drawings shown embodiment but may he varied within the scope of the claims without departing from the concept of the invention.

What is claimed is:

1. A running shoe having a heel and a toe and exhibiting a frame and an underlying sole, characterized in that the frame, which includes a front toe part and a rear heel part, is stiff in a downward direction, that the front toe part is arranged to extend from a linear orientation with respect to said frame to an upward bent orientation at an angle from the rear heel part of the frame, and that the sole is formed by a front circular sole member and a back circular sole member located at mutual distance from each other; the front part of said circular sole members exhibiting a break edge which is arranged to provide a fall function for the shoe after its contact with and roll off along a surface; the two circular sole members decrease in height in the direction towards the toe and heel part respectively of the shoe.

2. A running shoe having a heel and a toe and exhibiting a frame and an underlying sole, characterized in that the frame, which includes a front toe part and a rear heel part, is stiff in a downward direction, that the front toe part is arranged to extend from a linear orientation with respect to said frame to an upward bent orientation at an angle from the rear heel part of the frame, and that the sole is formed by a front circular sole member and a back circular sole member located at mutual distance from each other; the front part of said circular sole members exhibiting a break edge which is arranged to provide a fall function for the shoe after its contact with and roll off along a surface; the front circular sole member decreases in height in the direction towards the front toe part and the back circular sole member decreases in height in the direction towards the rear heel part.

* * * * *

UNITED STATES PATENT AND TRADEMARK OFFICE

CERTIFICATE OF CORRECTION

PATENT NO. : 6,393,735 B1
DATED : May 28, 2002
INVENTOR(S) : Berggren, Svante

It is certified that error appears in the above-identified patent and that said Letters Patent is hereby corrected as shown below:

Column 2,
Line 5, change "500º" to -- 50º --

Signed and Sealed this

Nineteenth Day of November, 2002

*Attest:*

*Attesting Officer*

JAMES E. ROGAN
*Director of the United States Patent and Trademark Office*